United States Patent [19]

Oya et al.

[11] Patent Number: 4,492,142

[45] Date of Patent: Jan. 8, 1985

[54] TIMBRE MODULATION CIRCUIT FOR ELECTRONIC MUSICAL INSTRUMENTS

[75] Inventors: Akiyoshi Oya; Akira Nakada; Tutomu Suzuki, all of Hamamatsu, Japan

[73] Assignee: Nippon Gakki Seizo Kabushiki Kaisha, Shizuoka, Japan

[21] Appl. No.: 382,309

[22] Filed: May 26, 1982

Related U.S. Application Data

[63] Continuation of Ser. No. 188,575, Sep. 18, 1980, abandoned, which is a continuation of Ser. No. 003,476, Jan. 15, 1979, abandoned.

[30] Foreign Application Priority Data

Jan. 18, 1978 [JP] Japan ..... 53-3928

[51] Int. Cl.[3] ..... G10F 1/00

[52] U.S. Cl. ..... 84/1.03; 84/1.19; 84/1.24; 84/DIG. 12

[58] Field of Search ..... 84/1.03, 1.01, DIG. 12, 84/DIG. 9, 1.19, 1.24

[56] References Cited

U.S. PATENT DOCUMENTS 3,890,871 6/1975 Oberheim ..... 84/1.03 X 3,999,458 12/1976 Suzuki ..... 84/1.19 X

*Primary Examiner*—F. W. Isen

*Attorney, Agent, or Firm*—Koda and Androlia

[57] ABSTRACT

A timbre modulation circuit for an electronic musical instrument having an automatic rhythm accompaniment system. The timbre modulation circuit is provided in a musical scale tone signal path and includes a means for generating a control pulse series synchronized with an automatic rhythm sound generation timing and a variable timbre circuit responsive to the control pulse series whereby the timbre characteristics are caused to vary in response to the control pulse series thereby modulating the timbre of the musical scale tones.

5 Claims, 2 Drawing Figures

TIMBRE MODULATION CIRCUIT FOR ELECTRONIC MUSICAL INSTRUMENTS

This is a continuation of application Ser. No. 188,575, filed Sept. 18, 1980, now abandoned, which is a continuation of Ser. No. 003,476, filed Jan. 15, 1979, now abandoned.

BACKGROUND OF THE INVENTION

1. Field of the Invention

This invention relates to musical instruments equipped with automatic rhythm accompaniment systems and more specifically to electronic musical instruments provided with a timbre circuit.

2. Prior Art

Conventionally, in electronic musical instruments, the playing of the keyboard and the operation of the automatic rhythm accompaniment section have been completely independent of each other. Accordingly, the musical sound signals being formed are formed by completely separate systems.

In such electrionic musical instruments, however, a certain monotony in playing has been unavoidable. Improvement in this area is desirable and an especially desirable goal is to introduce an effective musical-sound adornment function which is rich in variation by using an automatic rhythm accompanying system to the fullest extent.

SUMMARY OF THE INVENTION

Accordingly, it is a general object of the present invention to provide an electronic musical instrument in which monotony in playing is avoided.

It is another object of the present invention to provide an electronic musical instrument in which the timbre of the musical sound is caused to vary in synchronism with the automatic rhythm sound generation timing.

It is still another object of the present invention to provide an electronic musical instrument in which it is possible to provide accented playing.

In keeping with the principles and objects of the present invention, the objects are accomplished by a unique timbre modulation circuit for an electronic musical instrument having automatic rhythm accompaniment system. The timbre modulation circuit includes a means for generating a control pulse series synchronized with automatic rhythm sound generation timing and a variable timbre circuit responsive to the control pulse series whereby the timbre characteristics are caused to vary in response to the control pulse series.

BRIEF DESCRIPTION OF THE DRAWINGS

The above-mentioned features and objects of the present invention will become more apparent with reference to the following description taken in conjunction with the accompanying drawings, wherein like reference numerals denote like elements and in which.

DETAILED DESCRIPTION OF THE INVENTION

Figure 1:
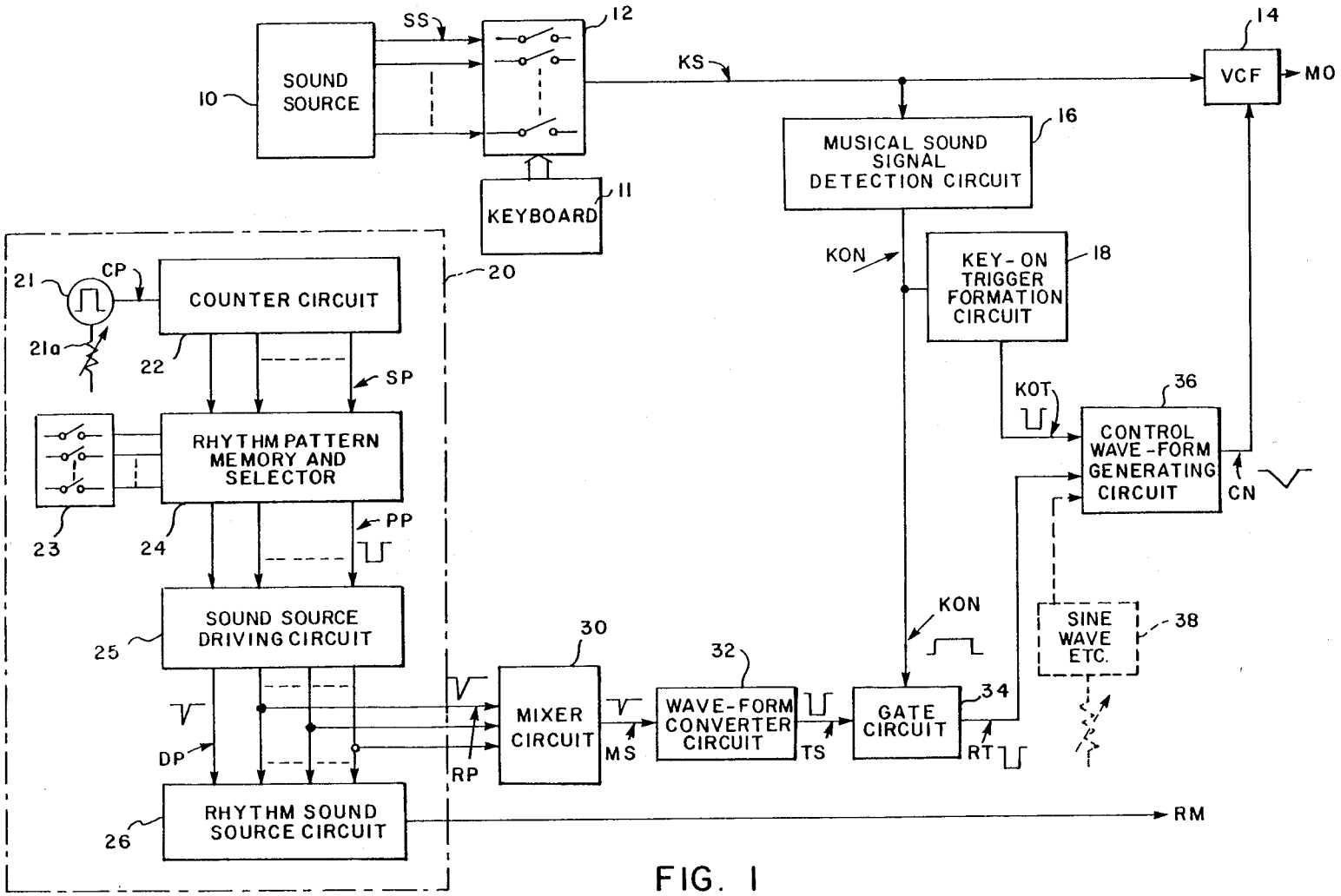
FIG. 1 is a block diagram illustrating one embodiment of a timbre modulation circuit for an electronic musical instrument in accordance with the teachings of the present invention.

Referring more particularly to the figures, shown in FIG. 1 is one embodiment of a timbre modulation circuit for an electronic musical instrument. In FIG. 1, the electronic musical instrument includes a sound source (tone generator) circuit 10, a keying circuit 12, a voltage controlled filter (VCF) 14 and an automatic rhythm accompaniment system 20.

The sound source circuit 10 outputs in parallel a plurality of sound source signals (tone signals) SS whose frequencies correspond to the notes in a musical scale to be sounded. Each time that any of the plurality of keys (not shown in the figures) are depressed, sound souce signals corresponding to the depressed keys are keyed and sent out by the keying circuit 12. The keyed musical sound signal KS from the keying circuit 12 is sent to the VCF 14 which acts as a variable timbre filter. Here, the desired timbre characteristics are added.

The musical sound signal MO generated by the VCF 14 is sent through a system (not shown in the figures) containing an amplitude envelope control circuit, an output amplifier, and an electroacoustic transducer, etc. and is sounded as a musical sound by the electroacoustic transducer.

A tempo clock signal generator 21, whose oscillation frequency is varied and set by means of a variable resistor 21*a*, is provided in the automatic rhythm accompaniment system 20. The tempo clock signals CP from the signal generator 21 are sent to a counter circuit 22. The counter circuit 22 consists of for example, a counter which repeatedly counts the tempo clock signals CP and a decoder which decodes the parallel outputs of the counter. The counter circuit 22 is designed such that it generates in parallel successive pulse signals SP for two measures. The successive pulse signals SP are sent to a circuit 24 which is controlled by a rhythm selector switch circuit 23. This circuit 24 contains a rhythm pattern memory and a rhythm selector. The rhythm pattern memory consists of a read-only memory (ROM) which memorizes rhythm patterns corresponding to the rhythms of for example, waltzes, rumbas, mambos, etc. The rhythm pattern memory receives the successive pulse signals SP as address signals and generates rhythm pattern pulse signals PP. The rhythm selector 23 controls the peripheral circuit of the rhythm pattern memory so that the specific rhythm pattern set by the rhythm selector switch circuit 23 is read out Accordingly, specified rhythm pattern pulse signals PP selected by the rhythm selector switch circuit 23 are generated from the output terminals of the circuit 24. the rhythm pattern pulse signals PP are sent to a sound source driving circuit 25 and are converted into driving pulse signals DP which are suitable for driving the rhythm sound source circuit 26. The rhythm sound source circuit 26 contains a rhythm sound source such as a bass drum, snare drum, cymbals, etc. and is driven and controlled by the driving pulse signals DP so that it generates a rhythm sound signal RM. This rhythm sound signal RM is converted into a corresponding acoustic signal by means of an electroacoustical transducer such as a speaker, etc.

The timbre control system is constructed so that it performs two functions. The first function of the timbre control system is based on a key-on signal and a second timbre control function is based on rhythm pulse signals. Specifically, the first timbre control function is performed by means of a first circuit system containing a musical sound signal detection circuit 16, a key-on trigger formation circuit 18, a control wave-form generating circuit 36 and the VCF 14. The second timbre control function is performed by means of a second circuit system which contains a mixer circuit 30 that receives the rhythm pulse signals RP, a wave-form converter circuit 32, a gate circuit 34, the control wave-form generating circuit 36 and the VCF 14.

In the first circuit system, the musical sound signal detection circuit 16 detects the keyed musical sound signal KS and generates a key-on signal KON which indicates a key-switch is in the on condition. This key-on signal KON is converted by the key-on trigger formation circuit 18 into a square-wave key-on trigger signal KOT which is synchronized with the rise of the sound. The key-on trigger signal KOT is sent to the control wave-form generating circuit 36. In response to the key-on trigger a signal KOT, the control wave-form generating circuit 36 generates a control wave-form signal CN. The control wave-form signal CN is sent to the control input terminal of the VCF 14. The VCF 14 is controlled by the control wave-form signal CN so that its cut-off frequency is altered. As a result of the control action described above, the musical sound signal MO obtained from the VCF 14 shows a change in timbre synchronized with the rise of the musical sound whenever a key-on condition exists. Thus, the so-called attack wow effect can be obtained.

Meanwhile, the mixer circuit 30, whose input consists of the rhythm pulse signals RP which are synchronized with the specified rhythm sound generation timing, is provided in the second circuit system and receives the driving pulse signals DP as rhythm pulse signal RP from the automatic rhythm accompaniment system 20. The mixer circuit 30 converts the parallel pulses it receives into a mixed pulse series MS consisting of pulses lined up in series. The mixed pulse series MS is converted into a square-wave pulse series TS by the wave-form converter circuit 32. The square-wave pulse series TS is provided to a gate circuit 34 which receives the key-on signal KON at its control input. Whenever the key-on signal KON indicates a key-on condition, the gate circuit 34 allows the square-wave pulse series TS to pass therethrough so that a rhythm trigger signal RT is generated. The gate circuit 34 is provided in order to prevent noise from being mixed in when there is no key-on condition. The rhythm trigger signal RT is provided to the control wave-form generating circuit 36. In response to the rhythm trigger signal RT, the control wave-form generating circuit 36 generates a control wave-form signal CN just as it does when it receives the key-on trigger signal KOT. Furthermore, the timbre characteristics of the VCF 14 are controlled by the control wave-form signal CN in the same manner as described above. Accordingly, as a result of the control action described above, the musical sound signal MO obtained from the VCF 14 shows a timbre variation that is synchronized with the specified rhythm sound generation timing.

It is apparent from the above that with the timbre modulation circuit shown in FIG. 1, a variation in timbre synchronized with the rise of the musical sound is obtained whenever there is a key-on condition, i.e. whenever a key is depressed. Furthermore, a variation in timbre synchronized with the rise of the rhythm sound is obtained whenever a rhythm sound is generated. Therefore, it is possible to generate a musical sound which is accompanied by the so-called wow effect.

In addition, it should be apparent that several modifications are possible to the embodiment described in FIG. 1. For example, the driving pulse signals DP in the automatic rhythm accompaniment system 20 were used as rhythm pulse signals RP. However, this invention is not limited to such an arrangement and it would also be possible to use the pulse series PP as the rhythm pulse signals RP. By using the pulse series PP as the rhythm pulse series RP, it would be possible to omit the wave-form converter circuit 32 and to drive the control wave-form generating circuit 26 directly with the output of the mixer circuit 30. Furthermore, it would also be possible to obtain the rhythm pulse signals RP from a separately installed synchronous pulse generator and thereby eliminate the need for using pulse signals from the automatic rhythm accompaniment system. Furthermore, in the above described embodiment the key-on signal KON was formed by detecting the musical sound signal. However, it would also be possible to detect the key-on signal directly from the keyswitch circuit.

Figure 2:
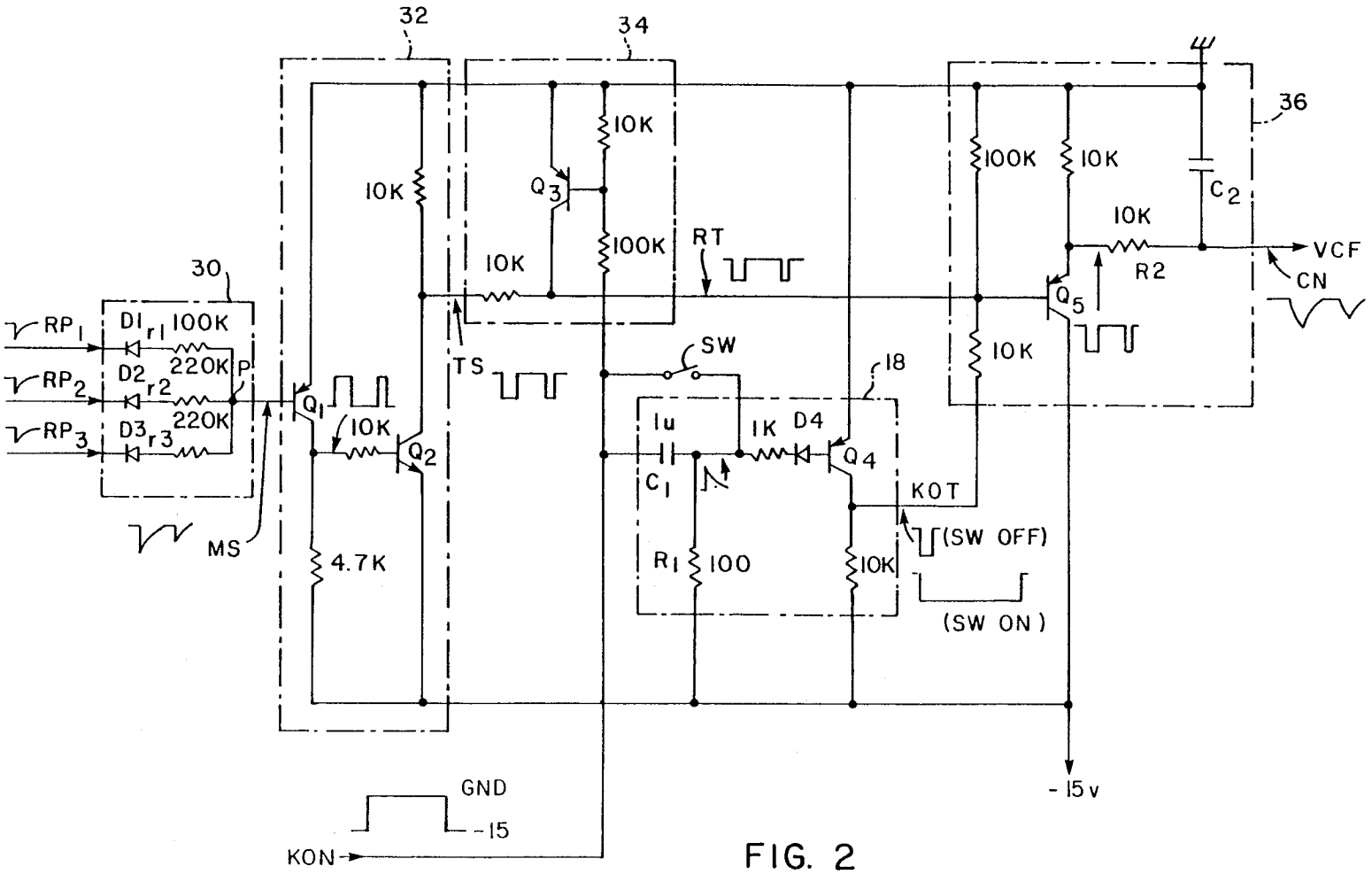
FIG. 2 is a detailed circuit diagram illustrating an embodiment of the control section of the circuit shown in FIG. 1.

Referring to FIG. 2, shown therein is the control section of the timbre modulation circuit shown in FIG. 1. The mixer circuit 30, which receives the rhythm pulses $RP_1$, $RP_2$ and $RP_3$ that are successively generated in synchronization with the rhythm sound generation timing, includes diodes D1, D2 and D3 which are used to prevent reverse current and resistors r1, r2 and r3 which have different resistance values (R1=100 kΩ, r2=220 kΩ, r3=220 kΩ), and which are respectively connected in series with the diodes D1, D2 and D3. The mixer circuit 30 is designed so that it generates a mixed pulse series MS via the point of mutual connection P of the resistors R1 through R3. Since the resistance values of the resistors r1 through r3 are different, the mixed pulse series MS consists of a series arranged pulses of different amplitude level even if the rhythm pulses RP1 through RP3 have identical amplitude values when they are provided as an input.

The wave-form converter circuit 32 is made of two switching transistors Q1 and Q2. The circuit 32 converts the mixed series arrange pulse series MS into a square-wave pulse series TS. The transistor Q1 is switched on whenever the pulses corresponding to the rhythm pulses RP1 through RP3 appear at the point P. The transistor Q2 is driven by the output of transistor Q1 and is switched on such that the square-wave pulse series TS is sent out as output from the collector side of the transistor Q2. In this case, since the amplitudes of the individual pulses in the mixed pulse series MS are different, the output pulses from transistor Q1 will have smaller pulse-widths if they have smaller input amplitudes, as is shown in FIG. 2. In response to the pulse of varying widths, the output pulse series TS from transistor Q2 also show similar variation in pulse-width. The gate circuit 34 contains a transistor Q3 which receives the key-on signal at its base. The transistor Q3 is designed such that it is switched on (rendered conductive) when the key-on signal KON has a level of −15V (key-off condition) and that such that it is switched off (rendered non-conductive) when the key-on signal KON has a ground GND level (key-on condition). A square-wave pulse series TS consisting of negative pulses is transmitted to the control wave-form generating circuit 36 only when the transistor Q3 is switched off (non-conductive).

At the same time, the key-on signal KON is provided to the key-on trigger formation circuit 18 and to a control switch SW. The key-on trigger formation circuit 18 includes a differentiation circuit which contains a capacitor C1 and a resistor R1. The key-on trigger formation circuit 18 also includes a switching transistor Q4 which receives the differentiated output from the capacitor C1 and a resistor R1 at its base via a rectifying diode D4. When the transistor Q4 is switched off by a differentiated pulse synchronized with the rise of the sound generated when the key-on signal KON changes from a −15 V level to a ground level, a key-on signal KOT containing a negative pulse is generated from the collector side of the transistor Q4. Meanwhile the control switch SW is connected in parallel with the differentiation circuit. When the switch SW is switched on (closed), the key-on signal KON is sent as the input to the switching transistor Q4 without passing through the differentiation circuit. Accordingly, when the control switch SW is switched on (closed), an inverted key-on signal $\overline{KON}$ consisting of a negative pulse which takes the form of an inverted positive key-on signal KON is generated from the output side of the transistor Q4.

The control wave-form generating circuit 36 generates a control wave-form signal CN in response to the three kinds of negative pulses described above, i.e. the rhythm trigger signal RT, key-on trigger signal KOT and the inverted key-on signal $\overline{KON}$. The control wave-form generating circuit 36 consists of switching transistor Q5 which receives the above described signals at its base and an integration circuit containing a resistor R2 and a capacitor C2 which integrate the emitter output of the transistor Q5. Whenever the rhythm trigger signal RT provided to the base of transistor Q5 has a negative level, the transistor Q5 is switched on and a negative pulse series, such as that shown in FIG. 2, is generated from the emitter side of the transistor Q5. This negative pulse series is converted into a control wave-form CN, such as shown in FIG. 2, by the integration circuit R2-C2. Here, it should be noted that the wave-form of the control wave-form signal CN varies according to the pulse-width variation of the rhythm trigger signal RT. The control wave-form signal CN is provided to the VCF 14 as a control input. As a result, a timbre change is obtained which is rich in variation and which corresponds to the wave-form variation of the control wave-form signal CN. Furthermore, whenever the key-on trigger signal KOT or the inverted key-on signal $\overline{KON}$ provided to the base of transistor Q5 are a negative level, transistor Q5 is switched on for as long as the respective input signals have a negative level and a control wave-form signal CN consisting of the integrated output corresponding to the switching action of the transistor is generated.

When the control switch SW is switched off, the control wave-form signals CN are formed in response to the rhythm trigger signal RT and the key-on trigger signal KOT. Accordingly, the timbre of the musical sound varies in synchronization with the rhythm sound generation timing and the key-on timing. In contrast when the control switch SW is switched on, the effect of the rhythm trigger signal RT in the on action of the transistor Q5 is absorbed by the effect of the inverted key-on signal $\overline{KON}$. As a result, a timbre varition synchronized with the automatic rhythm sound generation timing is not obtained; in this case, only a timbre variation synchronized with the rise and fall of the inverted key-on signal $\overline{KON}$ which is synchronized with key depression and key release is obtained.

From the above description, it is apparent this invention makes it possible to obtain a timbre variation which is synchronized with the rhythm sound generation timing and also makes it possible to obtain as desired a timbre variation which is synchronized only with the rise of the musical sound or with both the rise and fall of the musical sound. Accordingly, this invention possesses the superior advantage of making it possible to achieve a musical performance which avoids monotony and which is rich in variation.

In addition, it would be possible to modify the above described embodiment to make the musical performance even richer in variation. To make musical performance richer in variation, one need only install a variable-frequency oscillator 38 as indicated by the dotted line in FIG. 1 which generates a sine-wave output or an output of some other wave-form and provide the output of the oscillator 38 into the control wave-form generating circuit 36. Referring to FIG. 2, in reality the output of the oscillator 38 would be added to the base of transistor Q5 via a mixing resistance of approximately 10 kΩ.

It should be apparent to those skilled in the art that the above described embodiment is merely illustrative of but one of the many possible specific embodiments which represent the application of the principles of the present inventon. Numerous and varies other arrangements can be readily devised by those skilled in the art without departing from the spirit and scope of the invention.

I claim:

1. An electronic musical instrument comprising:

keyboard means having a plurality of keys;

tone signal generating means for generating a tone signal each time when at least one key among said plurality of keys is depressed, said tone signal having a frequency corresponding to the depressed key;

automatic rhythm accompaniment means which comprises tempo clock pulse generating means for generating tempo clock pulses, rhythm pattern signal generating means for generating a rhythm pattern signal in response to said tempo clock pulses, said rhythm pattern signal being a signal expressing a pattern of a certain rhythm, and sound source means for converting said rhythm pattern signal into a rhythm sound signal which is a musical tone signal different from said tone signal and representing a rhythmic sound of at least one rhythmic musical instrument;

control means responsive to said rhythm pattern signal for producing a control signal whose waveform is different from that of said rhythm pattern signal;

variable filter means receiving said tone signal from said tone signal generating means and having a control input terminal to which said control signal from said control means is applied to alter an amplitude-frequency characteristic of said variable filter means whereby the timbre characteristics of said tone signal from said tone generating means are caused to vary in synchronism with a generation timing of said rhythm sound signal.

2. An electronic musical instrument according to claim 1, wherein said rhythm pattern signal comprises a plurality of pattern signals, said rhythm pattern signal generating means generating in parallel said plurality of pattern signals which correspond to different rhythmic musical instruments respectively, and wherein said control means comprises converting means for converting said plurality of pattern signals which correspond to different rhythmic musical instruments respectively into a serial rhythm pattern signal which is equal to a serial form of said plurality of pattern signals generated in parallel and control signal generating means receiving said serial rhythm pattern signal for generating said control signal.

3. An electronic musical instrument according to claim 2, wherein said converting means comprises mixing means which mixes at different amplitude levels said plurality of pattern signals generated in parallel from said rhythm pattern signal generating means and sends out the mixed pattern signals in serial form as said serial rhythm pattern signal.

4. An electronic musical instrument according to claim 2, further comprising means for generating a key-on signal indicative of a key-on duration of the depressed key and a gate circuit responsive to said key-on signal for feeding said serial rhythm pattern signal to said control signal generating means.

5. An electronic musical instrument according to claim 1, wherein said rhythm pattern signal genrating means comprises memory means which stores a plurality of rhythm patterns, the different rhythm patterns corresponding to patterns of different rhythms respectively, and wherein said automatic rhythm accompaniment means further comprises selection means for selecting one among said plurality of rhythm patterns, said rhythm pattern signal corresponding to the selected rhythm pattern.

* * * * *